US010400774B2

(12) United States Patent
Nakagawa et al.

(10) Patent No.: US 10,400,774 B2
(45) Date of Patent: Sep. 3, 2019

(54) MULTI-STAGE COMPRESSION SYSTEM, CONTROL DEVICE, CONTROL METHOD, AND PROGRAM

(71) Applicant: MITSUBISHI HEAVY INDUSTRIES COMPRESSOR CORPORATION, Minato-ku (JP)

(72) Inventors: Yosuke Nakagawa, Tokyo (JP); Naoto Yonemura, Hiroshima (JP); Hiroyuki Miyata, Hiroshima (JP); Naoki Mori, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 397 days.

(21) Appl. No.: 15/314,394

(22) PCT Filed: Jun. 22, 2015

(86) PCT No.: PCT/JP2015/067858
§ 371 (c)(1),
(2) Date: Nov. 28, 2016

(87) PCT Pub. No.: WO2016/002557
PCT Pub. Date: Jan. 7, 2016

(65) Prior Publication Data

US 2017/0198705 A1 Jul. 13, 2017

(30) Foreign Application Priority Data

Jul. 1, 2014 (JP) ..... 2014-136052

(51) Int. Cl.
*F04D 27/00* (2006.01)
*F04D 17/12* (2006.01)
(Continued)

(52) U.S. Cl.
CPC ..... *F04D 27/001* (2013.01); *F04D 17/12* (2013.01); *F04D 27/009* (2013.01);
(Continued)

(58) Field of Classification Search
CPC ..... F04D 27/0292; F04D 27/0246; F04D 27/0253; F04D 27/009; F04D 27/0207; F04D 27/0269; F04D 17/12
See application file for complete search history.

(56) References Cited

U.S. PATENT DOCUMENTS 4,360,882 A * 11/1982 Stewart ..... F01D 17/24 415/15
4,554,788 A * 11/1985 Hwang ..... F01D 17/26 60/646
(Continued)

FOREIGN PATENT DOCUMENTS

JP 8-247335 A 9/1996
JP 9-6439 A 1/1997
(Continued)

OTHER PUBLICATIONS

International Search Report and Written Opinion of the International Searching Authority (Forms PCT/ISA/237 and PCT/ISA/210), dated Sep. 8, 2015, for International Application No. PCT/JP2015/067858, with an English translation.

*Primary Examiner* — Richard A Edgar
*Assistant Examiner* — Topaz L. Elliott
(74) *Attorney, Agent, or Firm* — Birch, Stewart, Kolasch & Birch, LLP.

(57) ABSTRACT

A multi-stage compression system in which gases compressed by a pair of first-stage compressors are compressed by subsequent compressors connected to the first-stage compressors in series includes a valve control unit configured to output open/close signals for opening/closing valves for adjusting flow rates of gases flowing into the first-stage
(Continued)

compressors provided at inlet sides of the first-stage compressors. The valve control unit outputs an open/close signal having a difference less than or equal to a predetermined value with respect to a degree of opening of the valve before malfunction determination as the open/close signal until a malfunction is eliminated after the determination of the malfunction in which one of the valves does not have a degree of opening according to the open/close signal.

8 Claims, 4 Drawing Sheets

(51) Int. Cl.
*F04D 29/46* (2006.01)
*F04D 27/02* (2006.01)

(52) U.S. Cl.
CPC ..... *F04D 27/0246* (2013.01); *F04D 27/0292* (2013.01); *F04D 29/462* (2013.01); *F05B 2270/108* (2013.01); *F05B 2270/1081* (2013.01); *F05B 2270/1095* (2013.01)

(56) References Cited

U.S. PATENT DOCUMENTS

| | | | | |
|---|---|---|---|---|
| 8,590,288 | B2 * | 11/2013 | Ishiba | B64C 29/0025 244/23 A |
| 8,977,518 | B2 * | 3/2015 | Blotenberg | F01D 17/00 702/182 |
| 10,036,395 | B2 * | 7/2018 | Takeda | F04D 27/0246 |
| 2009/0077946 | A1 | 3/2009 | Ishiba | |
| 2011/0040526 | A1 * | 2/2011 | Blotenberg | F01D 17/00 702/182 |
| 2014/0363269 | A1 * | 12/2014 | Takeda | F04D 27/0246 415/1 |
| 2015/0211518 | A1 * | 7/2015 | Park | F04D 27/0246 418/1 |

FOREIGN PATENT DOCUMENTS

| | | | |
|---|---|---|---|
| JP | 9-159047 | A | 6/1997 |
| JP | 2002-147253 | A | 5/2002 |
| JP | 2005140262 | A * | 6/2005 |
| JP | 2008-169985 | A | 7/2008 |
| JP | 2008-274931 | A | 11/2008 |
| JP | 2013-170573 | A | 9/2013 |

* cited by examiner

MULTI-STAGE COMPRESSION SYSTEM, CONTROL DEVICE, CONTROL METHOD, AND PROGRAM

TECHNICAL FIELD

The present invention relates to a multi-stage compression system, a control device, a control method, and a program.

Priority is claimed on Japanese Patent Application No. 2014-136052, filed Jul. 1, 2014, the content of which is incorporated herein by reference.

BACKGROUND ART

A compressor which compresses gases and supplies the compressed gases to machines or the like connected downstream is known. As this compressor, there is a compressor in which a gas flow rate for a compressor body is adjusted by arranging an inlet guide vane (IGV) upstream and adjusting a degree of opening of the IGV.

In Patent Document 1, technology of appropriately controlling a degree of opening of the IGV and performing an optimum operation even when a performance difference occurs among a plurality of compressor bodies is disclosed as related technology.

CITATION LIST

Patent Document

[Patent Document 1]

Japanese Unexamined Patent Application, First Publication No. 2013-170573

SUMMARY OF INVENTION

Technical Problem

By the way, when an alarm is generated in an abnormal state in the multi-stage compressor as disclosed in Patent Document 1, a function of switching a signal is provided so that a flow rate difference is not corrected. In this case, when a signal value suddenly changes, the overall plant is likely to be unstable.

Also, if the IGV is stuck (fixed and does not operate), an excessive force is applied to the IGV because a signal is continuously output from a controller even while the IGV is stuck and the excessive force is likely to be a cause of a failure. Also, when the IGV is recovered from the stuck state at any opportunity, the IGV suddenly moves and the plant is likely to be unstable.

Because the number of operation ends of IGV opening degree control is decremented by one when the IGV is stuck, controllability is deteriorated, but a countermeasure for this phenomenon is not considered.

Thus, technology capable of improving controllability without making the overall plant unstable even when an alarm is generated in an abnormal state in the multi-stage compressor is required.

The present invention provides a multi-stage compression system, a control device, a control method, and a program capable of solving the above-described problem.

Solution to Problem

According to a first aspect of the present invention, a multi-stage compression system compresses gases compressed by a pair of first-stage compressors by subsequent compressors connected to the first-stage compressors in series. The multi-stage compression system includes: a valve control unit configured to output open/close signals for opening/closing valves for adjusting flow rates of gases flowing into the first-stage compressors provided at inlet sides of the first-stage compressors, wherein the valve control unit outputs the open/close signal having a difference less than or equal to a predetermined value with respect to a degree of opening of the valve before malfunction determination as the open/close signal until a malfunction is eliminated after the determination of the malfunction in which one of the valves does not have a degree of opening according to the open/close signal.

According to a second aspect of the present invention, a multi-stage compression system is a multi-stage compression system in which gases compressed by a pair of first-stage compressors are compressed by subsequent compressors connected to the first-stage compressors in series, the multi-stage compression system including: a valve control unit configured to output open/close signals for opening/closing valves for adjusting flow rates of gases flowing into the first-stage compressors provided at inlet sides of the first-stage compressors, wherein the valve control unit stores the open/close signal during malfunction determination and supplies the stored open/close signal until a malfunction is eliminated.

According to a third aspect of the present invention, in the multi-stage compression system, the valve control unit stores an open/close signal during malfunction determination and limits the open/close signal of up to a necessary degree of opening to a predetermined change rate or less until the malfunction is eliminated.

According to a fourth aspect of the present invention, a multi-stage compression system is a multi-stage compression system in which gases compressed by a pair of first-stage compressors are compressed by subsequent compressors connected to the first-stage compressors in series, the multi-stage compression system including: a valve control unit configured to output open/close signals for opening/closing valves for adjusting flow rates of gases flowing into the first-stage compressors provided at inlet sides of the first-stage compressors, wherein the valve control unit outputs the open/close signal indicating a value of a degree of valve opening in normal times already determined during malfunction determination while maintaining the value after the malfunction determination when the open/close signal is output after the malfunction determination or outputs the open/close signal indicating a value of a degree of opening according to a newly measured opening degree determination signal after the malfunction determination.

According to a fifth aspect of the present invention, in the multi-stage compression system, the valve control unit increases control sensitivity of another valve in which no malfunction is determined until the malfunction is eliminated after the malfunction is determined.

According to a sixth aspect of the present invention, a control device is a control device of a multi-stage compressor in which gases compressed by a pair of first-stage compressors are compressed by subsequent compressors connected to the first-stage compressors in series, the control device including: a valve control unit configured to output open/close signals for opening/closing valves for adjusting flow rates of gases flowing into the first-stage compressors provided at inlet sides of the first-stage compressors, wherein the valve control unit outputs the open/close signal having a difference less than or equal to a predetermined value with respect to a degree of opening of the valve before malfunction determination as the open/close signal until a malfunction is eliminated after the determination of the malfunction in which one of the valves does not have a degree of opening according to the open/close signal.

According to a seventh aspect of the present invention, a control device is a control device of a multi-stage compressor in which gases compressed by a pair of first-stage compressors are compressed by subsequent compressors connected to the first-stage compressors in series, the control device including: a valve control unit configured to output open/close signals for opening/closing valves for adjusting flow rates of gases flowing into the first-stage compressors provided at inlet sides of the first-stage compressors, wherein the valve control unit stores the open/close signal during malfunction determination and supplies the stored open/close signal until a malfunction is eliminated.

According to an eighth aspect of the present invention, in the control device, the valve control unit stores an open/close signal during malfunction determination and limits the open/close signal of up to a necessary degree of opening to a predetermined change rate or less until the malfunction is eliminated.

According to a ninth aspect of the present invention, a control device is a control device of a multi-stage compressor in which gases compressed by a pair of first-stage compressors are compressed by subsequent compressors connected to the first-stage compressors in series, the control device including: a valve control unit configured to output open/close signals for opening/closing valves for adjusting flow rates of gases flowing into the first-stage compressors provided at inlet sides of the first-stage compressors, wherein the valve control unit outputs the open/close signal indicating a value of a degree of valve opening in normal times already determined during malfunction determination while maintaining the value after the malfunction determination when the open/close signal is output after the malfunction determination or outputs the open/close signal indicating a value of a degree of opening according to a newly measured opening degree determination signal after the malfunction determination.

According to a tenth aspect of the present invention, in the control device, the valve control unit increases control sensitivity of another valve in which no malfunction is determined until the malfunction is eliminated after the malfunction is determined.

According to an eleventh aspect of the present invention, a control method is a control method for use in a multi-stage compression system in which gases compressed by a pair of first-stage compressors are compressed by subsequent compressors connected to the first-stage compressors in series, the control method comprising: outputting, by a valve control unit, an open/close signal having a difference less than or equal to a predetermined value with respect to a degree of opening of a valve before malfunction determination as the open/close signal until a malfunction is eliminated after the determination of the malfunction in which one of the valves does not have a degree of opening according to the open/close signal compressors, wherein the valve control unit is configured to output open/close signals for opening/closing valves for adjusting flow rates of gases flowing into the first-stage compressors provided at inlet sides of the first-stage.

According to a twelfth aspect of the present invention, a control method is a control method for use in a multi-stage compression system in which gases compressed by a pair of first-stage compressors are compressed by subsequent compressors connected to the first-stage compressors in series, the control method comprising: storing, by a valve control unit, an open/close signal during malfunction determination and supplies the stored open/close signal until a malfunction is eliminated, wherein the valve control unit is configured to output open/close signals for opening/closing valves for adjusting flow rates of gases flowing into the first-stage compressors provided at inlet sides of the first-stage compressors.

According to a thirteenth aspect of the present invention, in the control method, the valve control unit stores an open/close signal during malfunction determination and limits the open/close signal of up to a necessary degree of opening to a predetermined change rate or less until the malfunction is eliminated.

According to a fourteenth aspect of the present invention, a control method for use in a multi-stage compression system in which gases compressed by a pair of first-stage compressors are compressed by subsequent compressors connected to the first-stage compressors in series, the control method comprising: outputting, by a valve control unit, an open/close signal indicating a value of a degree of valve opening in normal times already determined during malfunction determination while maintaining the value after the malfunction determination when the open/close signal is output after the malfunction determination or outputs the open/close signal indicating a value of a degree of opening according to a newly measured opening degree determination signal after the malfunction determination, wherein the valve control unit is configured to output open/close signals for opening/closing valves for adjusting flow rates of gases flowing into the first-stage compressors provided at inlet sides of the first-stage compressors.

According to a fifteenth aspect of the present invention, in the control method, the valve control unit increases control sensitivity of another valve in which no malfunction is determined until the malfunction is eliminated after the malfunction is determined.

According to a sixteenth aspect of the present invention, a program is a program configured to cause a computer of a control device of a multi-stage compressor in which gases compressed by a pair of first-stage compressors are compressed by subsequent compressors connected to the first-stage compressors in series to function as: a valve control device configured to output open/close signals for opening/closing valves for adjusting flow rates of gases flowing into the first-stage compressors provided at inlet sides of the first-stage compressors, wherein the program causes the valve control device to output the open/close signal having a difference less than or equal to a predetermined value with respect to a degree of opening of a valve before malfunction determination as the open/close signal until a malfunction is eliminated after the determination of the malfunction in which one of the valves does not have a degree of opening according to the open/close signal.

According to a seventeenth aspect of the present invention, a program is a program configured to cause a computer of a control device of a multi-stage compressor in which gases compressed by a pair of first-stage compressors are compressed by subsequent compressors connected to the first-stage compressors in series to function as: a valve control device configured to output open/close signals for opening/closing valves for adjusting flow rates of gases flowing into the first-stage compressors provided at inlet sides of the first-stage compressors, wherein the program causes the valve control device to store the open/close signal during malfunction determination and supply the stored open/close signal until a malfunction is eliminated.

According to an eighteenth aspect of the present invention, the program causes the valve control device to store an open/close signal during malfunction determination and limit the open/close signal of up to a necessary degree of opening to a predetermined change rate or less until the malfunction is eliminated.

According to a nineteenth aspect of the present invention, a program is a program configured to cause a computer of a control device of a multi-stage compressor in which gases compressed by a pair of first-stage compressors are compressed by subsequent compressors connected to the first-stage compressors in series to function as: a valve control device configured to output open/close signals for opening/closing valves for adjusting flow rates of gases flowing into the first-stage compressors provided at inlet sides of the first-stage compressors, wherein the program causes the valve control device to output the open/close signal indicating a value of a degree of valve opening in normal times already determined during malfunction determination while maintaining the value after the malfunction determination when the open/close signal is output after the malfunction determination or output the open/close signal indicating a value of a degree of opening according to a newly measured opening degree determination signal after the malfunction determination.

According to a twentieth aspect of the present invention, the program causes the valve control device to increase control sensitivity of another valve in which no malfunction is determined until the malfunction is eliminated after the malfunction is determined.

Advantageous Effects of Invention

According to the multi-stage compression system, the control device, the control method, and the program described above, it is possible to improve controllability without making the overall plant unstable even when an alarm is generated in an abnormal state in a multi-stage compressor.

DESCRIPTION OF EMBODIMENTS

[First Embodiment]

Figure 1:
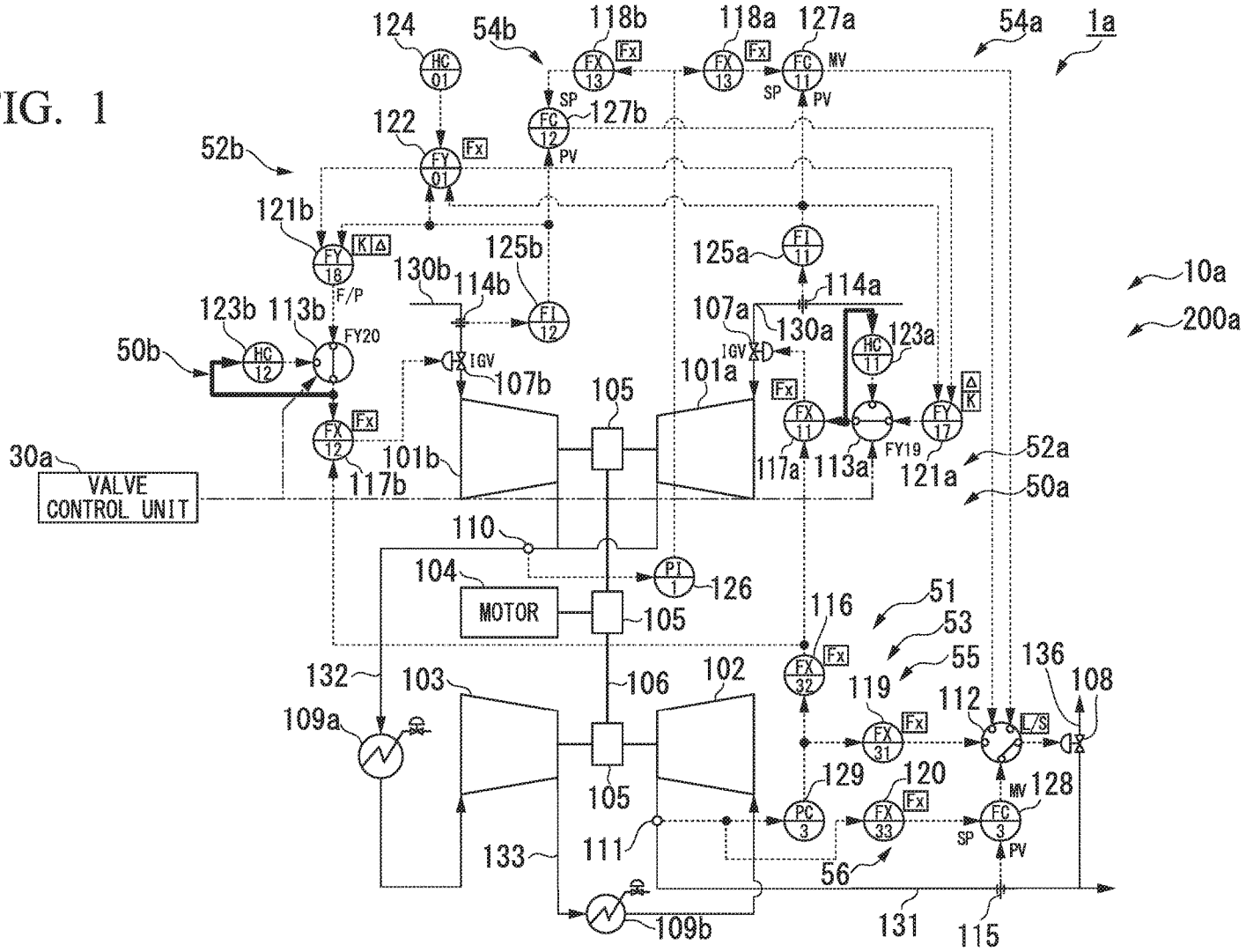
FIG. 1 is a diagram showing an example of a configuration of a multi-stage compression system according to a first embodiment of the present invention.

FIG. 1 is a diagram showing an example of a configuration of a multi-stage compression system 1*a* according to the first embodiment of the present invention.

A multi-stage compression system 1*a* according to the first embodiment includes a multi-stage compressor 10*a* and a compressor control device 200*a* (a control device).

The multi-stage compressor 10*a* includes first-stage compressor bodies 101 (101*a* and 101*b*) arranged in series from an upstream side of a flow of a gas to a downstream side, a second-stage compressor body 103 (a subsequent-stage compressor), and a last-stage compressor body 102 (a subsequent-stage compressor). The first-stage compressor body 101 is formed of a pair including the first-stage compressor body 101*a* and the first-stage compressor body 101*b*.

The first-stage compressor bodies 101 (101*a* and 101*b*), the second-stage compressor body 103, and the last-stage compressor body 102 are coupled via a shaft 106. The first-stage compressor bodies 101*a* and 101*b* are arranged to form a pair in parallel on the upstream side of the shaft 106. On the downstream side of the shaft 106, the second-stage compressor body 103 and the last-stage compressor body 102 are arranged in parallel. A motor 104 is connected to a middle portion of the shaft 106. Each compressor body and the motor 104 are connected to the shaft 106 via a gearbox 105.

Supply lines 130*a* and 130*b* are pipes for supplying gases to the first-stage compressor bodies 101*a* and 101*b*. The supply line 130*a* is connected to an inlet of the first-stage compressor body 101*a*. Also, the supply line 130*b* is connected to an inlet of the first-stage compressor body 101*b*. The first-stage compressor body 101*a* generates a compressed gas by taking in the gas via the supply line 130*a* and compressing the gas. The first-stage compressor body 101*b* generates a compressed gas by taking in the gas via the supply line 130*b* and compressing the gas.

A first connection line 132 is a pipe for supplying the compressed gas generated by the first-stage compressor bodies 101*a* and 101*b* to the second-stage compressor body 103. The first connection line 132 is connected to an outlet of the first-stage compressor body 101*a* and an outlet of the first-stage compressor body 101*b*. Also, the first connection line 132 is connected to an inlet of the second-stage compressor body 103. The first connection line 132 includes a merging portion and the compressed gases discharged by the two first-stage compressor bodies 101*a* and 101*b* are merged in the merging portion. The first connection line 132 supplies the merged compressed gases to the second-stage compressor body 103.

The second-stage compressor body 103 generates a compressed gas by further compressing the compressed gas taken in via the first connection line 132. A second connection line 133 is a pipe for supplying the compressed gas generated by the second-stage compressor body 103 to the last-stage compressor body 102. The second connection line 133 is connected to an outlet of the second-stage compressor body 103 and an inlet of the last-stage compressor body 102. The second connection line 133 supplies the compressed gas to the last-stage compressor body 102.

The last-stage compressor body 102 generates a compressed gas by further compressing the compressed gas taken in via the second connection line 133. A discharge line 131 is a pipe for supplying the compressed gas generated by the last-stage compressor body 102 to a downstream process. The discharge line 131 is connected to an outlet of the last-stage compressor body 102 and an inlet of the downstream process. The discharge line 131 supplies the compressed gas to the downstream process.

An inlet guide vane (hereinafter, IGV) 107*a* is provided in the supply line 130*a* around the inlet of the first-stage compressor body 101*a*. An IGV 107*b* is provided in the supply line 130*b* around the inlet of the first-stage compressor body 101*b*. The IGV 107*a* provided in the supply line 130*a* controls a flow rate of the gas flowing into the first-stage compressor body 101*a*. The IGV 107*b* provided in the supply line 130*b* controls a flow rate of the gas flowing into the first-stage compressor body 101*b*.

The discharge line 131 around an outlet of the last-stage compressor body 102 is provided with a blowoff valve 108. When the compressor is a compressor in which the gas to be compressed is air, the blowoff valve 108 provided in the discharge line 131 discharges air into the atmosphere via a blowoff line 136. Also, when the gas is nitrogen or the like, a recycle valve can be used. In this case, the blowoff valve 108 can return the gas to the supply line 130*a* via a recycle line by which the blowoff line 136 is connected to the supply line 130*a*. Also, the blowoff valve 108 can return the gas to the supply line 130*b* via the recycle line connected to the supply line 130*b* via the blowoff line 136.

The degrees of opening of IGV 107*a*, the IGV 107*b*, and the blowoff valve 108 are controlled for the purpose of controlling an outlet pressure of the multi-stage compressor 10*a* or preventing surging.

An inlet flow rate determination unit 114*a* is arranged at the supply line 130*a*. The inlet flow rate determination unit 114*a* determines an inlet gas flow rate of a gas flowing into the first-stage compressor body 101*a* and generates an inlet flow rate determination value. An inlet flow rate determination unit 114*b* is arranged at the supply line 130*b*. The inlet flow rate determination unit 114*b* determines an inlet gas flow rate of a gas flowing into the first-stage compressor body 101*b* and generates an inlet flow rate determination value.

A post-merger pressure determination unit 110 is arranged in the downstream side of the merging portion of the first connection line 132. The post-merger pressure determination unit 110 generates a post-merger pressure determination value by determining a pressure after the merging of the gases flowing out of the first-stage compressor bodies 101*a* and 101*b*. A cooler 109*a* is arranged at the first connection line 132. The cooler 109*a* cools the gas flowing inside the first connection line 132.

A cooler 109*b* is arranged at the second connection line 133. The cooler 109*b* cools the gas flowing inside the second connection line 133.

An outlet pressure determination unit 111 is arranged at the discharge line 131. The outlet pressure determination unit 111 generates an outlet pressure determination value by determining a pressure of the gas flowing out of the last-stage compressor body 102. Also, an outlet flow rate determination unit 115 is arranged at the discharge line 131. The outlet flow rate determination unit 115 generates an outlet flow rate determination value by determining the flow rate of the gas flowing out of the last-stage compressor body 102.

Next, a configuration of the compressor control device 200*a* in the first embodiment of the present invention will be described.

Figure 2:
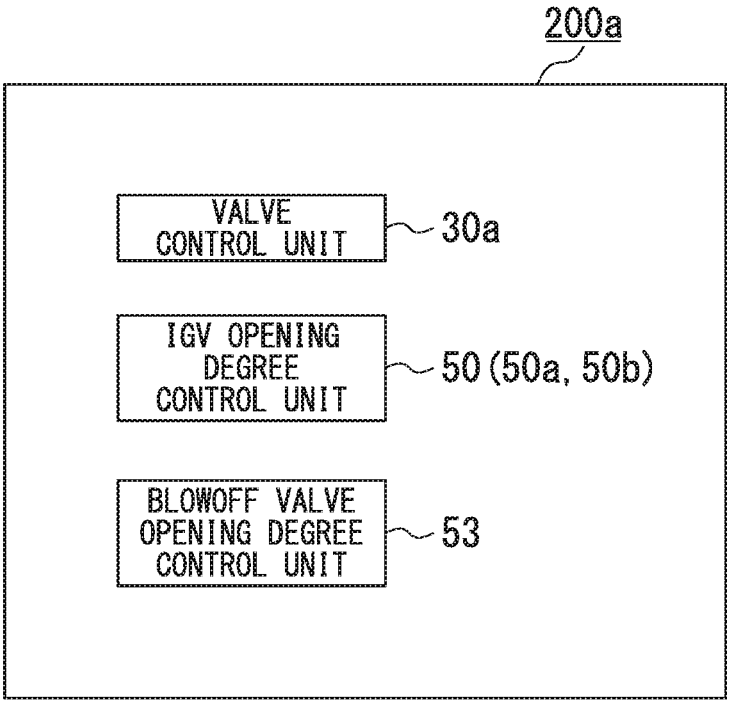
FIG. 2 is a diagram showing an example of a configuration of a compressor control device in the present embodiment.

FIG. 2 is a diagram showing an example of the configuration of the compressor control device 200*a* in the first embodiment of the present invention.

The compressor control device 200*a* in the first embodiment of the present invention is a configuration in which a valve control unit 30*a* is added to the compressor control device shown in FIG. 9 of Patent Document 1. The compressor control device 200*a* in the first embodiment includes a valve control unit 30*a*, IGV opening degree control units 50 (50*a* and 50*b*), and a blowoff valve opening degree control unit 53.

The IGV opening degree control unit 50*a* controls a degree of opening of the IGV 107*a*. The IGV opening degree control unit 50*b* controls a degree of opening of the IGV 107*b*. Configurations of the IGV opening degree control unit 50*a* and the IGV opening degree control unit 50*b* are identical.

The IGV opening degree control unit 50*a* includes an IGV opening degree command value generation unit 51 and an IGV opening degree command value correction unit 52*a*. The IGV opening degree control unit 50*b* includes the IGV opening degree command value generation unit 51 and an IGV opening degree command value correction unit 52*b*. The IGV opening degree command value generation unit 51 is common between the IGV opening degree control unit 50*a* and the IGV opening degree control unit 50*b*.

The IGV opening degree command value generation unit 51 generates and outputs an IGV opening degree command value indicating a degree of opening of the IGV 107*a*. The IGV opening degree command value generation unit 51 generates and outputs an IGV opening degree command value indicating a degree of opening of the IGV 107*b*. The IGV opening degree command value generation unit 51 includes a pressure controller 129 and a function generator 116.

The IGV opening degree command value correction units 52*a* and 52*b* correct an IGV opening degree command value output by the IGV opening degree command value generation unit 51.

The IGV opening degree command value correction unit 52*a* includes a flow rate indicator 125*a* which outputs an input inlet flow rate determination value as it is, a pressure indicator 126 which outputs an input post-merger pressure determination value as it is, and a function generator 117*a* which outputs an IGV opening degree correction value.

The IGV opening degree command value correction unit 52*b* includes a flow rate indicator 125*b* which outputs an input inlet flow rate determination value as it is, the pressure indicator 126 which outputs an input post-merger pressure determination value as it is, and a function generator 117*b* which outputs an IGV opening degree correction value.

The pressure indicator 126 is common between the IGV opening degree command value correction units 52*a* and 52*b*, but the present invention is not limited thereto.

The blowoff valve opening degree control unit 53 controls a degree of opening of the blowoff valve 108. The blowoff valve opening degree control unit 53 includes upstream-side anti-surge control units 54 (54*a* and 54*b*), an outlet pressure control unit 55, a downstream-side anti-surge control unit 56, and a command value selection unit 112.

Here, anti-surge control is control for maintaining a flow rate at a fixed value or more in order to prevent the multi-stage compressor 10*a* from being damaged by so-called surging caused by a decrease in a flow rate in the compressor.

The upstream-side anti-surge control unit 54*a* controls a degree of opening of the blowoff valve 108 in order to prevent surging from occurring in the first-stage compressor body 101*a*. The upstream-side anti-surge control unit 54*b* controls a degree of opening of the blowoff valve 108 in order to prevent surging from occurring in the first-stage compressor body 101*b*. Here, configurations of the upstream-side anti-surge control unit 54*a* and the upstream-side anti-surge control unit 54*b* are identical.

The upstream-side anti-surge control unit 54*a* includes a pressure indicator 126 which outputs an input post-merger outlet pressure determination value as it is, a function generator 118*a* which outputs an inlet flow rate target value, a flow rate indicator 125*a* which outputs an input inlet flow rate determination value as it is, and a flow rate controller 127*a* which outputs a blowoff valve opening degree command value on the basis of an inlet flow rate target value. The upstream-side anti-surge control unit 54*b* includes the pressure indicator 126 which outputs an input post-merger outlet pressure determination value as it is, a function generator 118*b* which outputs an inlet flow rate target value, a flow rate indicator 125*b* which outputs an input inlet flow rate determination value as it is, and a flow rate controller 127*b* which outputs a blowoff valve opening degree command value on the basis of an inlet flow rate target value.

Also, although the pressure indicator 126 is common between the upstream-side anti-surge control unit 54*a* and the upstream-side anti-surge control unit 54*b*, the present invention is not limited thereto.

The outlet pressure control unit 55 includes a pressure controller 129 which outputs an operation value for setting the input outlet pressure determination value to a setting value and a function generator 119 which outputs a blowoff valve opening degree command value.

The downstream-side anti-surge control unit 56 includes a function generator 120 which outputs an outlet flow rate target value and a flow rate controller 128 which outputs a blowoff valve opening degree command value on the basis of the outlet flow rate target value.

Also, the IGV opening degree command value correction unit 52*a* includes a performance difference correction coefficient generation unit 124, an inlet flow rate target value generation unit 122, and a function generator 121*a*. The IGV opening degree command value correction unit 52*b* includes the performance difference correction coefficient generation unit 124, the inlet flow rate target value generation unit 122, and a function generator 121*b*.

The performance difference correction coefficient generation unit 124 and the inlet flow rate target value generation unit 122 are common between the IGV opening degree command value correction unit 52*a* and the IGV opening degree command value correction unit 52*b*. The performance difference correction coefficient generation unit 124 generates and outputs a performance difference correction coefficient for correcting a performance difference between the two first-stage compressor bodies 101*a* and 101*b*. The performance difference correction coefficient and the inlet flow rate determination values in the first-stage compressor bodies 101*a* and 101*b* are input to the inlet flow rate target value generation unit 122 and inlet flow rate target values are generated for the first-stage compressor bodies 101*a* and 101*b*.

The inlet flow rate target values are input to the corresponding function generators 121*a* and 121*b*. The function generator 121*a* is provided in correspondence with a command value selection unit 113*a*. The function generator 121*b* is provided in correspondence with a command value selection unit 113*b*.

The inlet flow rate target value and the inlet flow rate determination value output from the corresponding flow rate indicator 125*a* are input to the function generator 121*a*. The inlet flow rate target value and the inlet flow rate determination value output from the corresponding flow rate indicator 125*b* are input to the function generator 121*b*. Function generators 121 (121*a* and 121*b*) generate and output IGV opening degree command correction values in proportion to a difference between the inlet flow rate target value and the inlet flow rate determination value. Here the function generators 121 (121*a* and 121*b*) may consider the integration of the difference between the inlet flow rate target value and the inlet flow rate determination value and generate and output the IGV opening degree command correction value.

Next, an operation of the compressor control device 200*a* according to the first embodiment will be described. Also, an operation in the compressor control device 200*a* according to the first embodiment corresponding to the compressor control device shown in FIG. 9 of Patent Document 1 will be omitted. Here, a valve control unit 30*a* will be described.

The valve control unit 30*a* inputs a value generated by the function generator 121*a* as the IGV opening degree correction signal input to the function generator 117*a* . The valve control unit 30*a* inputs a value for maintaining the output of the command value selection unit 113*a* to the function generator 117*a* when a correction signal from the function generator 121*a* is not input to the function generator 117*a* (when a correction signal in which a sudden change is likely to occur is not input) at the time of alarm generation such as IGV stuck determination.

Also, the value for maintaining the output of the command value selection unit 113*a* may be changed by an operator at the time of switching in the command value selection unit 113*a*.

Also, the valve control unit 30*a* inputs the value generated by the function generator 121b as the IGV opening degree correction signal input to the function generator 117*b* . The valve control unit 30*a* inputs a value for maintaining the output of the command value selection unit 113*b* to the function generator 117*b* when a correction signal from the function generator 121*b* is not input to the function generator 117*b* (when a correction signal in which a sudden change is likely to occur is not input) at the time of alarm generation such as IGV stuck determination.

As described above, in the multi-stage compression system 1*a*, the valve control unit 30*a* inputs a maintained value immediately after switching in the command value selection unit 113*a* to the function generator 117*a* when a correction signal is not input from the function generator 121*a* to the function generator 117*a* at the time of alarm generation such as IGV stuck determination. Also, the valve control unit 30*a* inputs a maintained value immediately after switching in the command value selection unit 113*b* to the function generator 117*b* when a correction signal is not input from the function generator 121*b* to the function generator 117*b* at the time of alarm generation such as IGV stuck determination.

That is, the multi-stage compression system 1*a* is a multi-stage compression system in which gases compressed by the pair of first-stage compressors 101 (101*a* and 101*b*) are compressed by subsequent-stage compressors (the second-stage compressor 103 and the last-stage compressor 102) connected in series to the first stage compressors 101. The multi-stage compression system 1*a* includes a valve control unit 30*a* which outputs open/close signals for opening/closing valves for adjusting flow rates of gases flowing into the first-stage compressors 101 provided at the inlet sides of the first-stage compressors 101. The valve control unit 30*a* stores the open/close signal during malfunction determination and supplies the stored open/close signal until the malfunction is eliminated.

Thus, the valve control unit 30*a* can suppress a sudden change of the correction signal. Thus, without making the overall plant unstable even when an alarm is generated in an abnormal state in the multi-stage compressor, the multi-stage compression system 1*a* can improve controllability.

<Second Embodiment>

Figure 3:
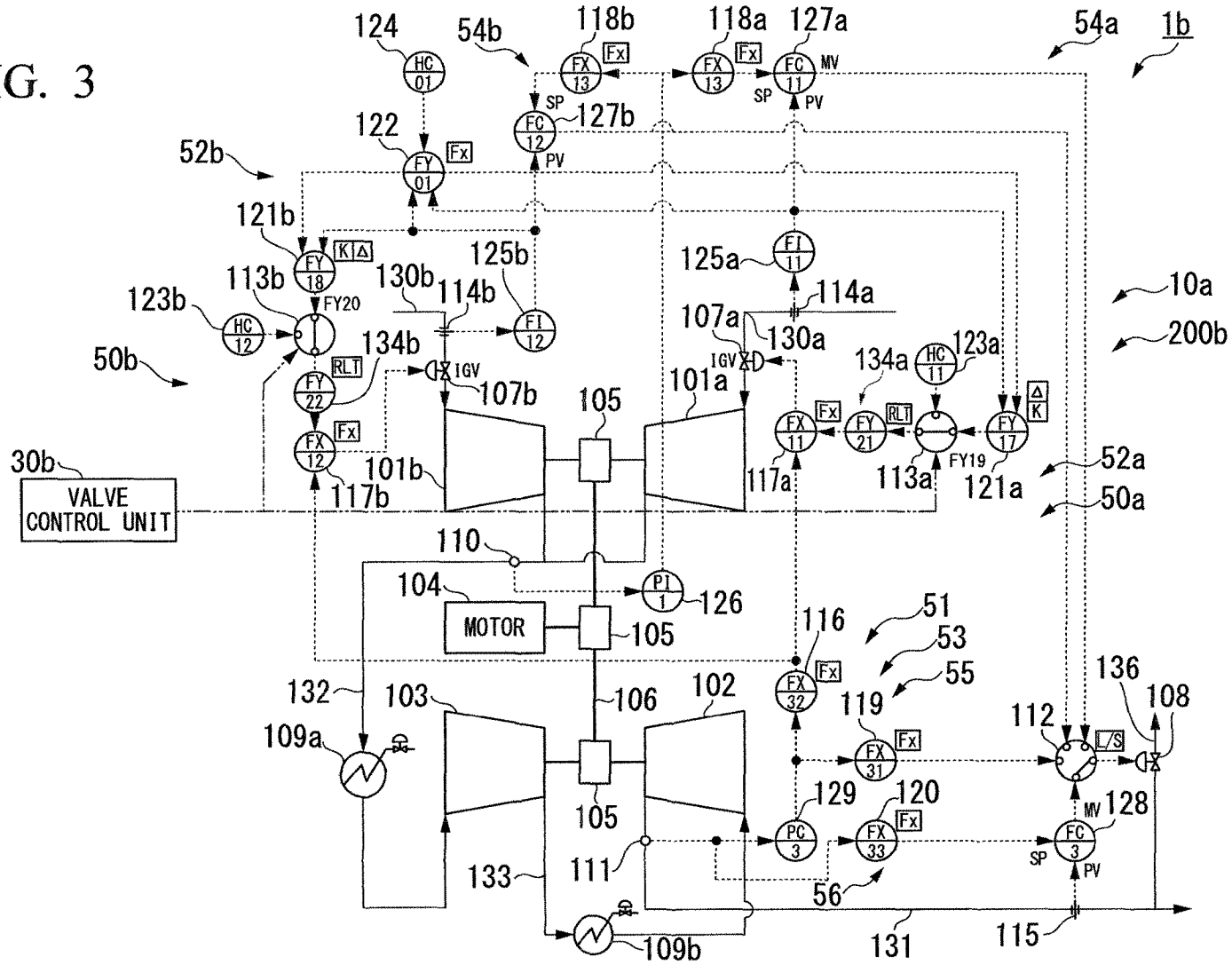
FIG. 3 is a diagram showing an example of a configuration of a multi-stage compression system according to a second embodiment of the present invention.

FIG. 3 is a diagram showing an example of a configuration of a multi-stage compression system 1*b* according to the second embodiment of the present invention.

The multi-stage compression system 1*b* according to the second embodiment includes a multi-stage compressor 10*a* and a compressor control device 200*b* (a control device).

The multi-stage compression system 1*b* according to the second embodiment is a system in which a change rate limiter 134*a* between the command value selection unit 113*a* and the function generator 117*a* of the multi-stage compression system 1*a* according to the first embodiment and a change rate limiter 134*b* between the command value selection unit 113*b* and the function generator 117*b* are added.

The change rate limiter 134*a* suppresses a change rate per unit time of the open/close signal of up to a necessary degree of opening input from the command value selection unit 113*a* within a predetermined range and outputs the suppressed change rate to the function generator 117*a*. Also, the change rate limiter 134*b* limits the change rate of a signal input from the command value selection unit 113*b* within a predetermined range and outputs the limited change rate to the function generator 117*b*.

The valve control unit 30*b* outputs the signal input from the command value selection unit 113*a* to the function generator 117*a* via the change rate limiter 134*a*. Also, the valve control unit 30*b* outputs the signal input from the command value selection unit 113*b* to the function generator 117*a* via the change rate limiter 134*b*. Also, the valve control unit 30*b* may constantly activate the change rate limiters 134*a* and 134*b*. Also the valve control unit 30*b* may activate the change rate limiters 134*a* and 134*b* only when an alarm is generated. Also, the valve control unit 30*b* may use technology disclosed in the first embodiment.

As described above, in the multi-stage compression system 1*b*, the valve control unit 30*b* outputs a signal input from the command value selection unit 113*a* to the function generator 117*a* via the change rate limiter 134*a*. Also, the valve control unit 30*b* outputs a signal input from the command value selection unit 113*b* to the function generator 117*b* via the change rate limiter 134*b*.

That is, the multi-stage compression system 1*b* is a multi-stage compression system in which gases compressed by the pair of first-stage compressors 101 (101*a* and 101*b*) are compressed by subsequent-stage compressors (the second-stage compressor 103 and the last-stage compressor 102) connected in series to the first stage compressors 101. The multi-stage compression system 1*b* includes a valve control unit 30*b* which outputs open/close signals for opening/closing valves for adjusting flow rates of gases flowing into the first-stage compressors 101 provided at the inlet sides of the first-stage compressors 101. The valve control unit 30*b* outputs an open/close signal having a difference less than or equal to a predetermined value with respect to a degree of opening of the valve before malfunction determination as the open/close signal until the malfunction is eliminated after the malfunction is determined.

The valve control unit 30*b* stores an open/close signal during malfunction determination and limits the open/close signal of up to a necessary degree of opening to a predetermined change rate or less until the malfunction is eliminated.

Thus, the valve control unit 30*b* can suppress a sudden change of the correction signal. Thus, without making the overall plant unstable even when an alarm is generated in an abnormal state in the multi-stage compressor, the multi-stage compression system 1*b* can improve controllability.

<Third Embodiment>

Figure 4:
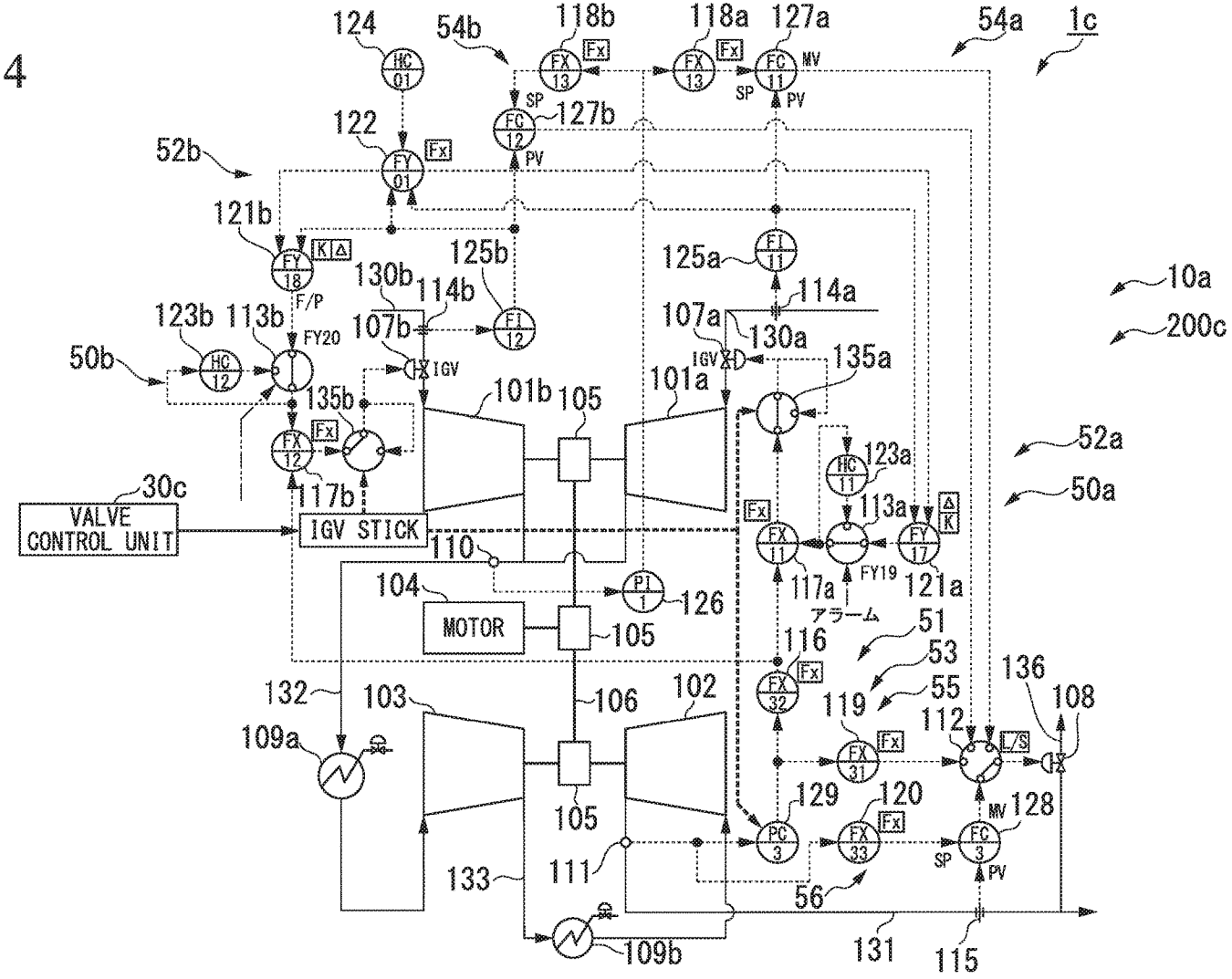
FIG. 4 is a diagram showing an example of a configuration of a multi-stage compression system according to a third embodiment of the present invention.

FIG. 4 is a diagram showing an example of a configuration of a multi-stage compression system 1*c* according to the third embodiment of the present invention.

The multi-stage compression system 1*c* according to the third embodiment includes a multi-stage compressor 10*a* and a compressor control device 200*c* (a control device).

The multi-stage compression system 1*c* according to the third embodiment is a system in which a selector 135*a* between the function generator 117*a* and the IGV 107*a* of the multi-stage compression system 1*a* according to the first embodiment and a selector 135*b* between the function generator 117*b* and the IGV 107*b* of the multi-stage compression system 1*b* according to the first embodiment are added.

The selector 135*a* outputs an output value of the function generator 117*a* to the IGV 107*a*. Alternatively, the selector 135*a* outputs an output value (an open/close signal indicating a fixed value) of the selector 135*a* or an actual IGV opening degree signal (a feedback signal according to an opening degree determination signal) to the IGV 107*a*.

Also, the selector 135*b* outputs the output value of the function generator 117*b* to the IGV 107*b*. Alternatively, the selector 135*b* outputs an output value of the selector 135*b* or the actual IGV opening degree signal to the IGV 107*b*.

The valve control unit 30*c* outputs an output value of the function generator 117*a* to the IGV 107*a* in normal times. Also, the valve control unit 30*c* outputs an output value of the function generator 117*b* to the IGV 107*b* in normal times.

When it is determined that the IGV 107*b* is stuck, the valve control unit 30*c* switches the selector 135*b* of the determined IGV 107*b* and outputs a selector output value for maintaining the open/close signal or the actual IGV opening degree signal to the IGV 107*b*. At this time, the IGV 107*a* which is not stuck continues the same operation as that in normal times and continues control of a compressor outlet pressure.

Also, the valve control unit 30*c* determines that the IGV is stuck, for example, when a difference between an IGV opening degree command value and an actual IGV opening degree signal is large (a degree of opening according to the open/close signal is not provided).

The valve control unit 30*c* changes a control parameter of compressor outlet pressure control when it is determined that the IGV 107*b* is stuck. For example, the valve control unit 30*c* changes a PID control gain of a pressure controller 129 to a gain twice a current gain on the basis of the number of operation ends reduced from 2 to 1. Thereby, the sensitivity of pressure controllability can be equivalent to that before malfunction determination. Also, the change of the PID control gain continues until a malfunction is eliminated and the gain returns to an original gain after the malfunction is eliminated.

As described above, in the multi-stage compression system 1*c*, the valve control unit 30*c* outputs an output value of the function generator 117*b* to the IGV 107*b* in normal times. Also, when it is determined that the IGV 107*b* is stuck, the valve control unit 30*c* switches the selector 135*b* of the determined IGV and outputs a selector output value or an actual IGV opening degree signal to the IGV 107*b*.

That is, the multi-stage compression system 1*c* is a multi-stage compression system in which gases compressed by the pair of first-stage compressors 101 (101*a* and 101*b*) are compressed by subsequent-stage compressors (the second-stage compressor 103 and the last-stage compressor 102) connected in series to the first stage compressors 101. The multi-stage compression system 1*c* includes a valve control unit 30*c* which outputs open/close signals for opening/closing valves for adjusting flow rates of gases flowing into the first-stage compressors 101 provided at the inlet sides of the first-stage compressors 101. The valve control unit 30*c* outputs an open/close signal indicating a value of a degree of valve opening in normal times already determined during malfunction determination while maintaining the value after the malfunction determination when the open/close signal is output after the malfunction determination. Alternatively, the valve control unit 30*c* outputs an open/close signal indicating a value of a degree of opening according to a newly measured opening degree determination signal after the malfunction determination.

The valve control unit 30*c* increases control sensitivity of another valve in which no malfunction is determined until the malfunction is eliminated after the malfunction is determined.

Thus, the valve control unit 30*c* can suppress a sudden change of the correction signal. Thus, without making the overall plant unstable even when an alarm is generated in an abnormal state in the multi-stage compressor, the multi-stage compression system 1*c* can improve controllability.

Also, an embodiment of the present invention has been described, but the above-described multi-stage compression system 1 internally includes a computer system. Each process described above may be stored in a computer-readable recording medium in the form of a program. The above-described process is performed by the computer reading and executing the program. Here, the computer-readable recording medium may be a magnetic disk, a magneto-optical disc, a compact disc read-only memory (CD-ROM), a digital versatile disc-read only memory (DVD-ROM), a semiconductor memory, or the like. In addition, the computer program may be distributed to the computer through a communication line, and the computer receiving the distributed program may execute the program.

Also, the above-described program may be a program for implementing some of the above-described functions. Further, the above-described program may be a program, i.e., a so-called differential file (differential program), capable of implementing the above-described function in combination with a program already recorded in the computer system.

Although some embodiments of the present invention have been described, these embodiments have been proposed as examples and are not intended to limit the range of the invention. These embodiments can be executed in various other modes. Various omissions, replacements, and changes can be made in a range not departing from the scope of the invention.

INDUSTRIAL APPLICABILITY

According to the multi-stage compression system, the control device, the control method, and the program described above, it is possible to improve controllability without making the overall plant unstable even when an alarm is generated in an abnormal state in a multi-stage compressor.

REFERENCE SIGNS LIST

1*a*, 1*b*, 1*c*, 1*d* Multi-stage compression system
10*a* Multi-stage compressor
30*a*, 30*b* Valve control unit
50*a*, 50*b* Inlet guide vanes (IGV) opening degree control unit
51 IGV opening degree command value generation unit
52*a*, 52*b* IGV opening degree command value correction unit
53 Blowoff valve opening degree control unit
54*a*, 54*b* Upstream-side anti-surge control unit
55 Outlet pressure control unit
56 Downstream-side anti-surge control unit
101, 101*a*, 101*b* First-stage compressor
102 Last-stage compressor
103 Second-stage compressor
104 Motor
105 Gearbox
106 Shaft
107*a*, 107*b* IGV
108 Blowoff valve
109*a*, 109*b* Cooler
110 Post-merger pressure determination unit
111, 138 Outlet pressure determination unit
112, 113*a*, 113*b* Command value selection unit
114*a*, 114*b* Inlet flow rate determination unit
115 Outlet flow rate determination unit
116, 117*a*, 117*b*, 118*a*, 118*b*, 119, 120, 121*a*, 121*b*, 122 Function generator
123*a*, 123*b* Correction cancellation signal generation unit
124 Performance difference correction coefficient generation unit
125*a*, 125*b* Flow rate indicator
126 Pressure indicator
127*a*, 127*b*, 128 Flow rate controller
129 Pressure controller
130*a*, 130*b* Supply line
131 Discharge line
132 First connection line
133 Second connection line
134*a*, 134*b* Change rate limiter
135*a*, 135*b* Selector
136 Blowoff line
200*a*, 200*b*, 200*c* Compressor control device

What is claimed is:

1. A multi-stage compression system in which gases compressed by a pair of first-stage compressors are compressed by subsequent compressors connected to the first-stage compressors in series, the multi-stage compression system comprising:

a valve control unit configured to output open/close signals for opening/closing a pair of valves for adjusting flow rates of gases flowing into the first-stage compressors, each of the pair of the first-stage compressors being provided with one of the valves at a respective inlet side, wherein, after a malfunction determination in which one of the valves does not have a degree of opening according to the corresponding open/close signal is made, the valve control unit limits and provides the corresponding open/close signal to each of the valves until the malfunction is eliminated, wherein, for each of the valves, the limited corresponding open/close signal is limited such that a change rate of the commanded degree of opening of the valve by the limited corresponding open/close signal is within a predetermined range, and wherein, for each of the valves, difference between the commanded degree of opening of the valve by the limited corresponding open/close signal and the commanded degree of opening of the valve before the malfunction determination is less than or equal to a predetermined value.

2. The multi-stage compression system according to claim 1, wherein, after the malfunction is determined, the valve control unit increases control sensitivity of another valve in which no malfunction is determined until the malfunction is eliminated.

3. A control device of a multi-stage compressor in which gases compressed by a pair of first-stage compressors are compressed by subsequent compressors connected to the first-stage compressors in series, the control device comprising:

a valve control unit configured to output open/close signals for opening/closing a pair of valves for adjusting flow rates of gases flowing into the first-stage compressors, each of the pair of the first-stage compressors being provided with one of the valves at a respective inlet side, wherein, after a malfunction determination in which one of the valves does not have a degree of opening according to the corresponding open/close signal is made, the valve control unit limits and provides the corresponding open/close signal to each of the valves until the malfunction is eliminated, wherein, for each of the valves, the limited corresponding open/close signal is limited such that a change rate of the commanded degree of opening of the valve by the limited corresponding open/close signal is within a predetermined range, and wherein, for each of the valves, difference between the commanded degree of opening of the valve by the limited corresponding open/close signal and the commanded degree of opening of the valve before the malfunction determination is less than or equal to a predetermined value.

4. The control device according to claim 3, wherein, after the malfunction is determined, the valve control unit increases control sensitivity of another valve in which no malfunction is determined until the malfunction is eliminated.

5. A control method for use in a multi-stage compression system in which gases compressed by a pair of first-stage compressors are compressed by subsequent compressors connected to the first-stage compressors in series, the multi-stage compression system comprising a valve control unit configured to output open/close signals for opening/closing a pair of valves for adjusting flow rates of gases flowing into the first-stage compressors, each of the pair of the first-stage compressors being provided with one of the valves at a respective inlet side, the control method comprising:

limiting and providing, by the valve control unit, after a malfunction determination in which one of the valves does not have a degree of opening according to the corresponding open/close signal is made, the corresponding open/close signal to each of the valves until the malfunction is eliminated, wherein, for each of the valves, the limited corresponding open/close signal is limited such that a change rate of the commanded degree of opening of the valve by the limited corresponding open/close signal is within a predetermined range, and wherein, for each of the valves, difference between the commanded degree of opening of the valve by the limited corresponding open/close signal and the commanded degree of opening of the valve before the malfunction determination is less than or equal to a predetermined value.

6. The control method according to claim 5, wherein, after the malfunction is determined, the valve control unit increases control sensitivity of another valve in which no malfunction is determined until the malfunction is eliminated.

7. A non-transitory computer readable storage medium that stores a program configured to cause a computer of a control device of a multi-stage compressor in which gases compressed by a pair of first-stage compressors are compressed by subsequent compressors connected to the first-stage compressors in series to function as:

a valve control device configured to output open/close signals for opening/closing a pair of valves for adjusting flow rates of gases flowing into the first-stage compressors, each of the pair of the first-stage compressors being provided with one of the valves at a respective inlet side, wherein the program causes the valve control device to limit and provide, after a malfunction determination in which one of the valves does not have a degree of opening according to the corresponding open/close signal is made, the corresponding open/close signal to each of the valves until the malfunction is eliminated, wherein, for each of the valves, the limited corresponding open/close signal is limited such that a change rate of the commanded degree of opening of the valve by the limited corresponding open/close signal is within a predetermined range, and wherein, for each of the valves, difference between the commanded degree of opening of the valve by the limited corresponding open/close signal and the commanded degree of opening of the valve before the malfunction determination is less than or equal to a predetermined value.

8. The non-transitory computer readable storage medium according to claim 7, wherein, after the malfunction is determined, the program causes the valve control device to increase control sensitivity of another valve in which no malfunction is determined until the malfunction is eliminated.

* * * * *